United States Patent [19]

Mariyama

[11] 4,349,715

[45] Sep. 14, 1982

[54] CASSETTE TAPE CONTROLLED MICROWAVE COOKING APPARATUS

[75] Inventor: Ryoiti Mariyama, Habikino, Japan

[73] Assignee: Sharp Kabushiki Kaisha, Osaka, Japan

[21] Appl. No.: 188,496

[22] Filed: Sep. 18, 1980

[30] Foreign Application Priority Data

Sep. 21, 1979 [JP] Japan ..... 54-122429

[51] Int. Cl.[3] ..... H05B 6/68

[52] U.S. Cl. ..... 219/10.55 B; 219/10.55 E; 99/325

[58] Field of Search ..... 219/10.55 B, 10.55 R, 219/10.55 E; 99/325; 434/321; 360/1, 12; 340/692, 505

[56] References Cited

U.S. PATENT DOCUMENTS

| | | | |
|---|---|---|---|
| 3,569,656 | 3/1971 | White | 219/10.55 B |
| 3,582,949 | 6/1971 | Forst | 360/12 X |
| 3,996,671 | 12/1976 | Foster | 434/321 |
| 4,159,490 | 6/1979 | Wood | 360/12 X |

FOREIGN PATENT DOCUMENTS

| | | | |
|---|---|---|---|
| 2026726 | 2/1980 | United Kingdom | 219/10.55 B |

*Primary Examiner*—B. A. Reynolds
*Assistant Examiner*—Philip H. Leung
*Attorney, Agent, or Firm*—Birch, Stewart, Kolasch & Birch

[57] ABSTRACT

A combined microwave and electric heater oven including a digital control system for controlling operations of a magnetron and a sheath heater, and a cassette tape player system for reproducing audio information and a digital data recorded on a cassette tape. The cassette tape includes a first track on which the audio information related to a cooking explanation is recorded, and a second track on which the digital data related to a cooking program is recorded. The audio information derived from the first track is applied to a speaker system for audibly providing the cooking explanation. The digital data derived from the second track is applied to the digital control system for controlling the operations of the magnetron and the sheath heater in accordance with the cooking program.

10 Claims, 5 Drawing Figures

CASSETTE TAPE CONTROLLED MICROWAVE COOKING APPARATUS

BACKGROUND AND SUMMARY OF THE INVENTION

The present invention relates to a cooking apparatus which includes a cassette tape player system for audibly announcing an explanation concerning cooking.

Recently, a microwave oven has been developed which includes a microcomputer control system for controlling a cooking operation in a digital fashion. In such a system, a keyboard panel is provided for selecting a desired cooking mode, a preferred cooking period, a preferred microwave output level, etc. An example of a microwave oven including a programmable digital control circuit is described in copending application Ser. No. 792,222, now U.S. Pat. No. 4,255,639, "MICROWAVE OVEN WITH A PROGRAMMABLE DIGITAL CONTROL CIRCUIT," filed on Apr. 29, 1977 by Tsuneo Kawabata, Minoru Makita and Sigeaki Masuzawa and assigned to the same assignee as the present application.

However, the above-mentioned digital control microwave oven is not easy to handle, because the operator is required to actuate many switches before initiating the cooking operation. To facilitate the data introduction, a magnetic card controlled microwave oven has been developed, wherein a typical cooking program is recorded on a magnetic card and the actual cooking operation is conducted in accordance with the data recorded on the magnetic card. In such a system, the operator is required only to select the corresponding magnetic card and insert it into a reader system employed in the microwave oven. An example of the magnetic card controlled microwave oven is described in copending application Ser. No. 974,037, "MAGNETIC CARD CONTROL MICROWAVE OVEN," filed on Dec. 27, 1978 by Keiichiro Doi, Minoru Makita and Masaaki Kawada, and assigned to the same assignee as the present application.

Even in such a magnetic card controlled microwave oven, preparation of materials and cooking ware, and seasoning, stirring and turning-over during the cooking operation must be conducted by the operator. Such instructions or explanations are printed on a cooking advise book. Therefore, the operator must look into the cooking advise book to conduct the actual cooking operation.

Accordingly, an object of the present invention is to provide a cooking apparatus including a cassette tape player system for audibly announcing the cooking explanation.

Another object of the present invention is to provide a combination microwave and electric heater oven including a cassette tape player system for audibly announcing the cooking explanation and for digitally controlling the cooking operation.

Other objects and further scope of applicability of the present invention will become apparent from the detailed description given hereinafter. It should be understood, however, that the detailed description and specific examples, while indicating preferred embodiments of the invention, are given by way of illustration only, since various changes and modifications within the spirit and scope of the invention will become apparent to those skilled in the art from this detailed description.

To achieve the above objects, pursuant to an embodiment of the present invention, a cassette tape player system and an audio system are included in a combination microwave and electric heater oven for audibly announcing the cooking explanation. A tape drive system is provided for intermittently driving a cassette tape for providing the audio announcement at a desired timing.

In a preferred form, the cassette tape player system is the two track type, and the cassette tape includes four tracks, two of them being for reverse operation. The audio announcement is recorded on the first and fourth tracks, and a digital data related to the cooking program is recorded on the second and third tracks. The combination microwave and electric heater oven includes a digital control circuit which responds to the digital data derived from the cassette tape player system, thereby controlling the operation of a microwave generation source or the electric heater. The audio information and the digital data recorded on the cassette tape are correlated with each other so that a suitable audible explanation is generated at a desired timing during a course of the cooking sequence.

BRIEF DESCRIPTION OF THE DRAWINGS

The present invention will be better understood from the detailed description given hereinbelow and the accompanying drawings which are given by way of illustration only, and thus are not limitative of the present invention and wherein.

DESCRIPTION OF THE PREFERRED EMBODIMENTS

Figure 1:
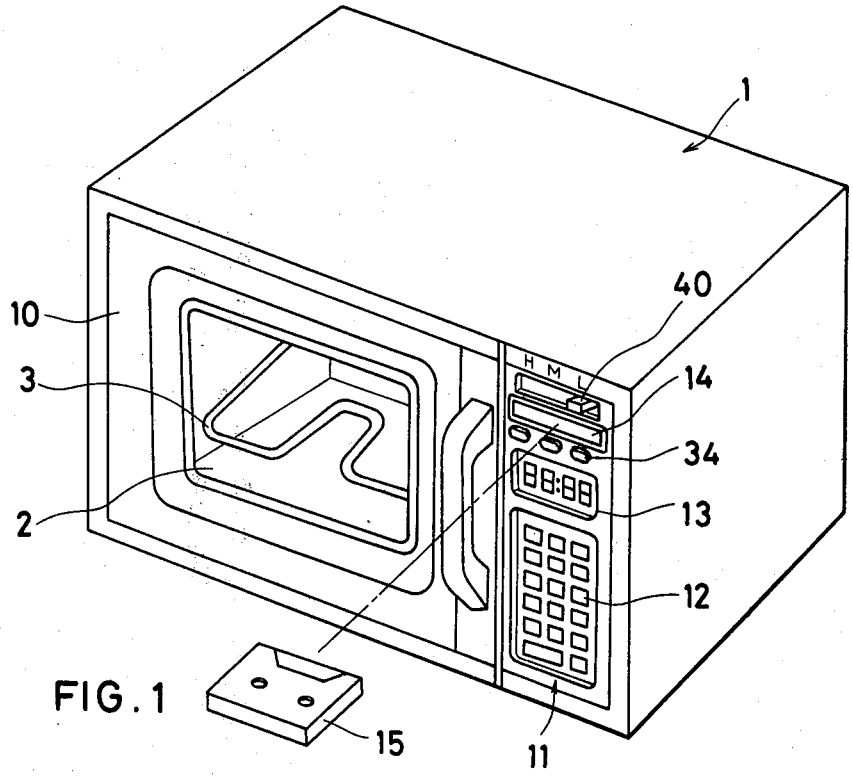
FIG. 1 is a perspective view of an embodiment of a combination microwave and electric heater oven of the present invention.

A combination microwave and electric heater oven of the present invention comprises a housing 1 and an oven cavity 2 surrounded by oven walls. A sheath heater 3 is disposed in the oven cavity 2 for grilling the foodstuff, and a magnetron 4 is secured to the oven wall for microwave cooking purposes. The microwave energy generated by the magnetron 4 is supplied to the oven cavity 2 through a waveguide 5. A power supply circuit comprising a high voltage transformer 6 and a condenser 7 is secured to the housing 1 for supplying the power to the magnetron 4. A blower fan motor 8 is associated with a blower fan 9 which functions to cool the magnetron 4.

An oven door 10 and a control panel 11 are disposed at the front face of the housing 1. The control panel 11 includes a keyboard panel 12, a digital display unit 13, a cassette tape inlet 14 for accommodating a cassette tape 15, and a heater position control knob 40 for adjusting the heater location in the oven cavity 2. The keyboard panel 12 is to introduce numeral information such as a set temperature and a set cook time period, and cooking commands. That is, the keyboard panel 12 is an input unit for performing the digital controlled cooking operation. A typical construction of the digital controlled microwave oven is disclosed in copending application Ser. No. 792,222, "MICROWAVE OVEN WITH A PROGRAMMABLE DIGITAL CONTROL CIRCUIT," filed on Apr. 29, 1977 by Tsuneo Kawabata, Minoru Makita and Sigeaki Masuzawa, and assigned to the same assignee as the present application. The heater position control knob 40 is to select the heater height between "High", "Middle" and "Low". A typical construction for shifting the heater location in the oven cavity is shown and described in U.S. Pat. No. 4,137,442, "HIGH-FREQUENCY OVEN HAVING A BROWNING UNIT," issued on Jan. 30, 1979.

Behind the control panel 11, a cassette tape player system 18 is disposed to confront the cassette tape inlet 14. The cassette tape player system 18 comprises a tape drive motor 16, and two magnetic reproduction heads 17*a* and 17*b*. A printed circuit board 19 is disposed behind the keyboard panel 12 for supporting the control circuit of the combination microwave and electric heater oven. First and second relays 20 and 21 are connected to the control circuit for controlling the operation of the magnetron 4 and the sheath heater 3, respectively. A speaker system 24 is associated with the cassette tape player system 18 for providing an audible explanation derived from the cassette tape player system 18. More specifically, cooking explanations are recorded on the cassette tape 15, and the tape drive motor 16 drives the cassette tape 15 at a desired timing for generating the audible explanation.

Figure 2:
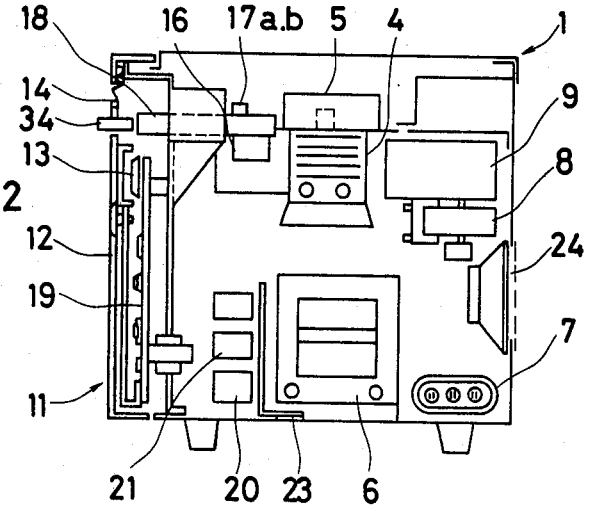
FIG. 2 is a sectional view of the combination microwave and electric heater oven of FIG. 1.
Figure 3:
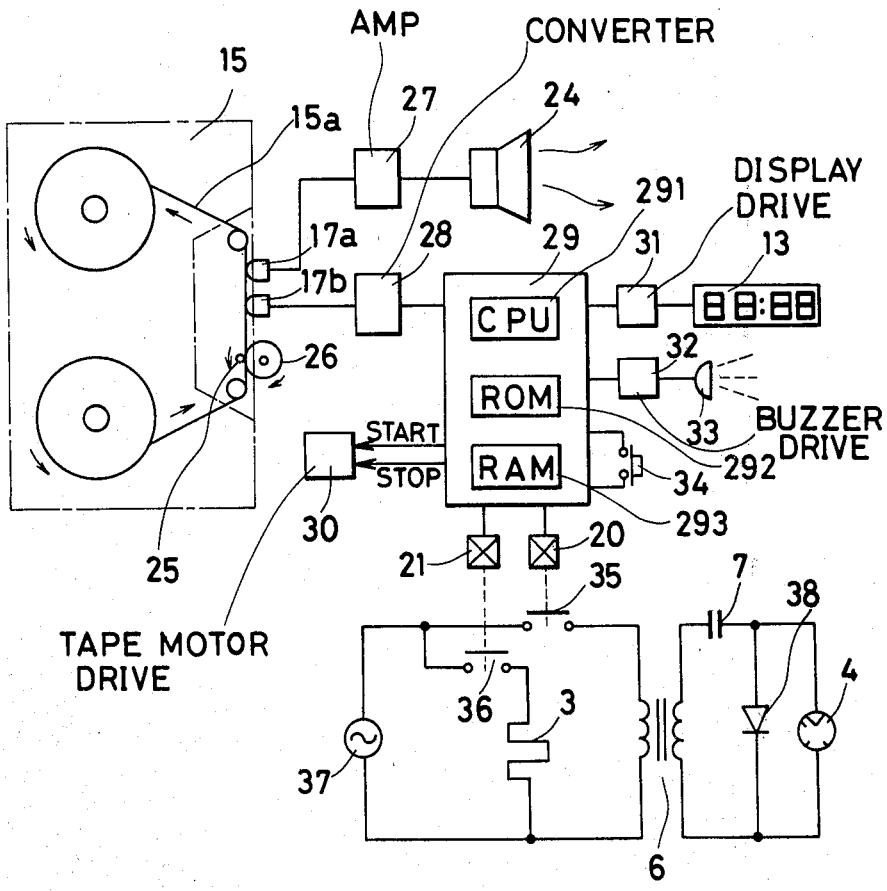
FIG. 3 is a block diagram of a control system included in the combination microwave and electric heater oven of FIG. 1.

FIG. 3 schematically shows a control system of the combination microwave and electric heater oven of the present invention. Like elements corresponding to those of FIGS. 1 and 2 are indicated by like numerals.

A capstan 25 is connected to the tape drive motor 16. When a pinch roller 26 is depressed toward the capstan 25, a magnetic tape 15*a* is driven to travel in the direction shown by arrows in FIG. 3 for reproduction purposes. The two magnetic reproduction heads 17*a* and 17*b* are made contact with two tracks recorded on the magnetic tape 15*a*, respectively, for reproducing recorded information.

Figure 4:
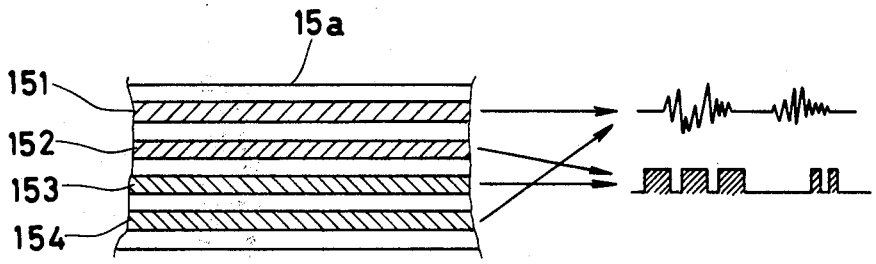
FIG. 4 is a schematic chart for explaining a recording condition on a cassette tape which is loaded on a cassette tape player system included in the combined microwave and electric heater oven of FIG. 1.

FIG. 4 shows recording tracks on the magnetic tape 15*a*. A first track 151 and a second track 152 are assigned to the forward direction drive, and a third track 153 and a fourth track 154 are assigned to the reverse direction drive. On the first and fourth tracks 151 and 154, audio information is recorded through the use of the analog recording technique for providing an audible cooking explanation. On the second and third tracks 152 and 153, digital information is recorded through the use of the saturation recording technique such as the phase encoding technique for providing a digital data which controls the cooking operation performed by the combination microwave and electric heater oven.

The magnetic reproduction head 17*a* contacts the first track 151 or the fourth track 154. The audio information output reproduced from the magnetic reproduction head 17*a* is applied to an audio amplifier 27 for activating the speaker system 24. The magnetic reproduction head 17*b* contacts the second track 152 or the third track 153. The digital information output derived from the magnetic reproduction head 17*b* is introduced into a read-out amplifier 28, whereby the digital information output is converted into a binary code signal and applied to a digital control system 29.

The digital control system 29 comprises a central processor unit 291, a read only memory 292 and a random access memory 293. The binary code signal applied to the digital control system 29 is processed in the digital control system 29, thereby providing a control signal for controlling the operation of the combination microwave and electric heater oven in accordance with a preselected program sequence. A motor driver circuit 30 is associated with the digital control system 29 for driving the tape drive motor 16 at a desired timing. More specifically, the digital control system 29 develops a start signal for initiating the rotation of the tape drive motor 16, and a stop signal for terminating the rotation of the tape drive motor 16. A display driver circuit 31 is associated with the digital control system 29 for driving the digital display unit 13 in accordance with the digital display data derived from the magnetic reproduction head 17*a*. More specifically, the digital display unit 13 is adopted to display the programmed cooking period or the programmed cooking condition in a digital fashion. A buzzer driver circuit 32 and a buzzer 33 are associated with the digital control system 29. A typical construction of the digital control system 29 is disclosed in copending application Ser. No. 792,222, "MICROWAVE OVEN WITH A PROGRAMMABLE DIGITAL CONTROL CIRCUIT."

A tape start button 34 is disposed on the control panel 11 for controlling the cassette tape drive. When the tape start button 34 is actuated, the start signal is developed from the digital control system 29. The first relay 20 is associated with a first control switch 35 which is disposed between the high voltage transformer 6 and an AC power source 37. The high voltage transformer 6 functions, in combination with the condenser 7 and a diode 38, to energize the magnetron 4. The second relay 21 is associated with a second control switch 36 which is disposed between the sheath heater 3 and the AC power source 37. The relays 20 and 21 are controlled by control signals developed from the digital control system 29.

Figure 5:
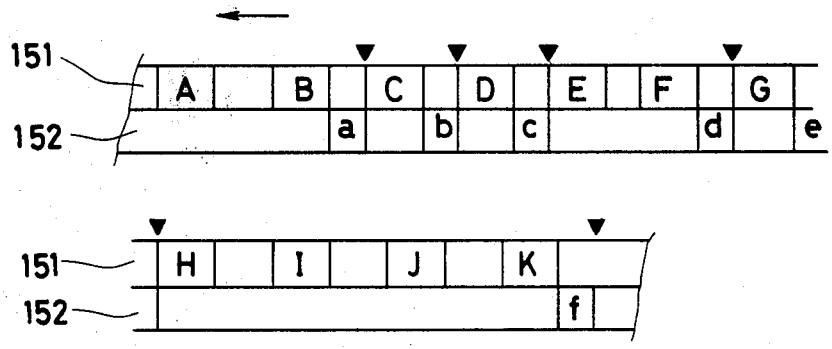
FIG. 5 is a schematic chart for explaining audio information and a digital data recorded on the cassette tape of FIG. 4.

An operation mode of the above discussed combination microwave and electric heater oven will be described with reference to an example, wherein "MITARASHI DANGO" (a kind of dumpling) is cooked by the combination microwave and electric heater oven. FIG. 5 schematically shows recorded condition on the first and second tracks 151 and 152 of the data for performing the "MITARASHI DANGO" cooking. In FIG. 5, empty sections show nonrecorded sections and a cassette tape drive is stopped at a position marked by a symbol "▼". Each of the recorded sections A, B, C, D, E, F, G, H, I, J, K, a, b, c, d, e, and f stores audio information or digital information as shown in the following table.

TABLE (MITARASHI DANGO)

| First Track | Second Track | Recorded Information |
|---|---|---|
| A | | "The followings are explanations regarding MITARASHI DANGO cooking. Please open the COOKBOOK, page 111." |
| | | (nonrecorded section of 15 second period) |
| B | | "Are you ready? Well, prepare materials with reference to the material column. Please be careful that the amount is for MITARASHI DANGO of eight sticks. In addition to the |

TABLE-continued (MITARASHI DANGO)

| First Track | Second Track | Recorded Information |
|---|---|---|
| | | materials, please select a heat-resistant bowl, an earthenware mortar, a wooden pestle, eight sticks of bamboo skewers, and a toasting net." "The tape drive will be stopped and the audio explanation will never appear while you are preparing. When the preparation is completed, please actuate the tape start button positioned under the cassette tape inlet." |
| | a | motor rotation stop instruction signal |
| C | | "Well, first of all, put the quality of rice flour and sugar into the earthenware mortar. Pour in the boiling water gradually, mix them sufficiently, and then put on the lid." "The quality of rice flour becomes smooth when you completely mixed it with the boiling water. You may add starch a little to make the dumpling firm." "The tape drive will be stopped till you finish the kneading. When you finished, place the earthenware mortar in the oven cavity, close the oven door, and actuate the tape start button positioned under the cassette tape inlet." |
| | b | mortar rotation stop instruction signal |
| D | | "Now, high power microwave cooking will be conducted for five minutes. Please prepare the bamboo skewers while the microwave cooking is performed. When the microwave cooking is completed, please take out the earthenware mortar from the oven cavity, and actuate the tape start button." "Well, the microwave cooking is started." |
| | c | instruction command data for performing the high power microwave cooking for five minutes; and motar rotation stop instruction signal |
| E | | "Please grind the heated body with the wooden pestle to smooth it. Dip your hand into water, round the heated body in a desired size, and thrust the bamboo skewer into the rounded body." "Then, let's make the soy soup. Put the soy, sugar and water into the heat-resistant bowl, and mix them up." (nonrecorded section of 30 second period) |
| F | | "Did you mix them up? Then, put the bowl into the oven cavity and close the oven door." "High power microwave cooking will be conducted for two minutes. While the microwave cooking is performed, prepare the starch and water of the same amount." "When the microwave cooking is completed, please take out the bowl from the oven cavity, and actuate the tape start button." "Well, the microwave cooking is initiated." |
| | d | instruction command data for performing the high power microwave cooking for two minutes; and motar rotation stop instruction signal. |
| G | | "Please add the starch and water into the heated soy soup, and mix them up. Additional high power microwave cooking will be conducted for one minute to provide the sticky soy soup." "Well, put the bowl into the oven cavity and close the oven door. When the microwave cooking is terminated, please take out the bowl, and actuated the tape start button." |
| | e | instruction command data for performing the high power microwave cooking for one minute; and motar rotation stop instruction signal |
| H | | "please dip the dumplings supported by the bamboo skewer into the soy soup." (nonrecorded section of 20 second period) |
| I | | "Paint the toasting net with the salad oil, and put the dumplings on the toasting net." |
| J | | "Dispose the dumplings supported by the toasting net on the tray in the oven cavity, and adjust the heater position at the Low position through the use of the heater position control knob." (nonrecorded section of 20 second period) |
| K | | "Now, please shut the door. High power microwave cooking will be conducted for two minutes, and then grill oven heating will be conducted for seven minutes. When the cooking is completed, a buzzer sound will indicate to you the completion of the MITARASHI DANGO cooking." "When you take out the MITARASHI DANGO from the oven cavity, please remember that the oven cavity is at a high temperature. The sheath heater should be shifted to the High position through the use of the heater position control knob, and take out the toasting net with a wet cloth." "Well, the final cooking will be conducted, Please wait for the buzzer sound." |
| | f | instruction command data for performing the high power microwave cooking for two minutes; instruction command data for performing the grill oven heating for seven minutes; and motor rotation stop instruction signal |

As shown in the above table, the cooking explanations are recorded on the first track 151 as audio sound signals, and the cooking program is recorded on the second track 152 as digital data signals. Accordingly, the cooking explanations are automatically developed from the combination microwave and electric heater oven, and the microwave and electric heater cooking is automatically conducted when the cassette tape 15 is loaded on the cassette tape player system 18 and the tape start button 34 is actuated.

When the tape start button 34 is actuated, the digital control system 29 develops the start signal to rotate the tape drive motor 16 via the motor driver circuit 30. First, the audio information of the block A recorded on the first track 151 is reproduced by the first magnetic reproduction head 17*a* and, therefore, the cooking explanation, "The followings are explanations regarding MITARASHI DANGO cooking. Please open the COOK BOOK, page 111," is generated from the speaker system 24. The next appearing nonrecorded section of 15 second period is provided for allowing the operator to open the indicated page of the cook book. Subsequently, the audio information of the block B is reproduced, and the cooking explanation, "Are you ready? Well, prepare materials . . . ", is generated from the speaker system 24. Thereafter, the motor rotation stop instruction signal recorded in the block a on the second track 152 is reproduced by the second magnetic reproduction head 17*b* and applied to the digital control system 29 via the read-out amplifier 28. The digital control system 29 develops the stop signal to terminate the rotation of the tape drive motor 16. That is, the tape drive is interrupted while the operator is preparing the materials in accordance with the previously generated cooking explanations. When the preparation is completed, the operator actuations the tape start button 34 to receive the next cooking explanation.

In this way, the cooking explanations are provided at desired timings. When the digital data recorded in the block d on the second track 152 is reproduced by the second magnetic reproduction head 17*a* after the cooking explanation recorded in the block F on the first track 151, the digital control system 29 develops control signals for performing the high power microwave cooking for two minutes and for stopping the tape drive. The first control switch 35 is closed through the first relay 20 and the tape drive is terminated. The A.C. power is supplied to the magnetron power supply circuit to activate the magnetron 4. The soy soup is heated for two minutes by the microwave energy. When the two minute microwave cooking is completed, the digital control system 29 develops a control signal for activating the buzzer 33 via the buzzer driver circuit 32, thereby informing the operator of the completion of the soy soup heating. In response to the buzzer sound, the operator takes out the bowl from the oven cavity and actuates the tape start button 34 to receive the next cooking explanation recorded in the block G on the first track 151.

When the operation is conducted to the last block f, the two minute microwave cooking instruction and the seven minute grill oven heating instruction are introduced into the digital control system 29. The first control switch 35 is closed to conduct the high power microwave cooking for two minutes, and then the second control switch 36 is closed via the second relay 21 to energize the sheath heater 3 for seven minutes. That is, the dumplings supported by the bamboo skewers and painted with the soy soup are heated by the microwave energy for two minutes and, thereafter, heated and browned for seven minutes through the use of the radiating heat energy generated by the sheath heater 3. When the seven minute grill oven heating is completed, the digital control system 29 develops a control signal for activating the buzzer 33 through the buzzer driver circuit 32, thereby announcing the completion of the MITARASHI DANGO cooking.

The invention being thus described, it will be obvious that the same may be varied in many ways. Such variations are not to be regarded as a departure from the spirit and scope of the invention, and all such modifications are intended to be included within the scope of the following claims.

What is claimed is:

1. An automatic and manual microwave oven for conducting a cooking operation and providing audible cooking instructions comprising:

a housing including an oven cavity and a cavity closure door;

microwave generating means for supplying microwave energy to said oven cavity for performing a cooking operation;

a cassette tape player system for reproducing information recorded on a cassette tape, said cassette tape carrying audio information for providing an audible cooking explanation and digital data for controlling the operation of said microwave generating means;

an audio system for generating the audible cooking explanation in accordance with the audio information reproduced by said cassette tape player system;

a digital control system for controlling the operation of said microwave generating means in accordance with the digital data reproduced by said cassette tape player system to be operable for predetermined time intervals; and tape drive means for intermittently imparting correlated rotation to said cassette tape for initially explaining a cooking operation by actuating said audio system for generating an audible cooking explanation and subsequently imparting correlated rotation to said cassette tape for controlling a cooking operation by actuating said digital control system for controlling the operation of the microwave generating means.

2. An automatic and manual microwave oven according to claim 1, wherein said cassette tape includes at least two recording tracks, a first track carrying said audio information and a second track carrying said digital data;

said cassette tape player system includes a first reproduction head associated with said first track, and a second reproduction head associated with said second track;

said first reproduction head is connected to said audio system; and said second reproduction head is connected to said digital control system.

3. An automatic and manual microwave oven according to claim 1 or 2, wherein said digital data includes a microwave power selection command, a cooking time period instruction signal, and a cooking sequence program data signal.

4. An automatic and manual microwave oven according to claim 1, and further comprising a tape start manual switch for initiating the operation of said cassette tape player system at a desired time.

5. An automatic and manual microwave oven according to claim 4, and further comprising a buzzer, and a buzzer driver circuit, wherein said digital control system developes an activating signal supplied to said buzzer driver circuit when a cooking operation is completed in accordance with said digital data reproduced by said cassette tape player system.

6. An automatic and manual microwave oven for conducting a cooking operation and providing audible cooking instructions comprising:

a housing including an oven cavity and a cavity closure door;

microwave generating means for supplying microwave energy to said oven cavity for performing a cooking operation;

control means for controlling said microwave generating means to be operable for predetermined time intervals;

reproduction means for reproducing information recorded on a recording medium for supplying an input to said control means; said information including control input and audible cooking instructions input;

an audio system for generating an audible cooking explanation in accordance with said audible cooking instructions input;

said control means including a digital control system comprising a central processor unit, a read only memory and a random access memory, an activation button being manually operatively connected to said digital control system to activate said digital control system in response to a command during said audible cooking explanation, a first relay operatively connected to said digital control system and to a first control switch for controlling the energization of said microwave generating means in response to an output from said digital control system; and recording medium drive means for intermittently imparting correlated rotation to said recording medium for initially explaining a cooking operation by actuating said audio system for generating an audible cooking explanation and subsequently imparting correlated rotation to said recording medium for controlling a cooking operation by actuating said digital control system for controlling the operation of the microwave generating means.

7. An automatic and manual cooking apparatus according to claim 6, and further comprising a reproduction start manual switch for initiating the operation of said drive means at a desired time.

8. An automatic and manual microwave oven according to claim 6, and further including a heat generating means operatively positioned within said oven cavity, a second relay being operatively connected to said digital control system and to a second control switch for controlling the energization of said heat generating means in response to an output from said digital control system.

9. An automatic and manual microwave oven according to claim 6, and further including a buzzer means operatively connected to said digital control system for producing an audible signal upon the completion of a cooking operation.

10. An automatic and manual microwave oven according to claim 6, 8 or 9, wherein said recording medium is a cassette tape and said reproduction means is a cassette tape player.

* * * * *